US006430858B1

(12) United States Patent
Andre

(10) Patent No.: US 6,430,858 B1
(45) Date of Patent: Aug. 13, 2002

(54) WALL ART PICTURE DECORATED WITH ELECTRIC LAMPS

(76) Inventor: Joseph Andre, 4001 S. Decatur Blvd., Suite 37-PMB 600, Las Vegas, NV (US) 89103

( * ) Notice: Subject to any disclaimer, the term of this patent is extended or adjusted under 35 U.S.C. 154(b) by 96 days.

(21) Appl. No.: 09/584,129

(22) Filed: May 31, 2000

(51) Int. Cl.[7] ..... A47G 1/06
(52) U.S. Cl. ..... 40/714; 40/550; 362/812
(58) Field of Search ..... 40/714, 550, 553, 40/559, 540, 716, 546; 362/248, 249, 812, 31

(56) References Cited

U.S. PATENT DOCUMENTS

| | | | | | |
|---|---|---|---|---|---|
| 1,190,910 | A | * | 7/1916 | Knorpp, Jr. | 40/540 |
| 3,096,942 | A | | 7/1963 | Madansky | |
| 3,794,962 | A | * | 2/1974 | Clark | 439/562 |
| 3,800,267 | A | | 3/1974 | Burgess et al. | |
| 4,021,949 | A | * | 5/1977 | Niehaus et al. | 40/361 |
| 4,492,685 | A | | 1/1985 | Lin | |
| 4,748,756 | A | * | 6/1988 | Ross | 40/715 |
| 4,819,353 | A | | 4/1989 | Glucksman et al. | |
| 4,839,776 | A | | 6/1989 | Grossnickle | |
| 4,922,384 | A | | 5/1990 | Torrence | |
| 4,967,317 | A | * | 10/1990 | Plumly | 362/31 |
| 5,163,748 | A | | 11/1992 | Messinger | |
| 5,226,725 | A | | 7/1993 | Trusiani | |
| 5,247,745 | A | | 9/1993 | Valentino | |
| 5,424,924 | A | * | 6/1995 | Ewing et al. | 362/545 |
| 5,438,959 | A | * | 8/1995 | Stone et al. | 119/248 |
| 5,440,468 | A | * | 8/1995 | Savage, Jr. | 362/226 |
| 5,463,502 | A | * | 10/1995 | Savage, Jr. | 359/819 |
| 5,534,315 | A | * | 7/1996 | Witte | 428/7 |
| 5,546,687 | A | * | 8/1996 | Iorfida | 40/546 |
| 5,957,562 | A | * | 9/1999 | Hill | 362/35 |
| 6,036,334 | A | * | 3/2000 | Nakano | 362/234 |

* cited by examiner

*Primary Examiner*—J. J. Swann
*Assistant Examiner*—William L. Miller
(74) *Attorney, Agent, or Firm*—Jack Lo

(57) ABSTRACT

The present wall art picture is comprised of a front panel display board and a rear panel enclosing board mounted in a frame. A poster featuring the graphical image of a light-emitting object is mounted to the outer surface of the front panel display board. A hole is made in the front panel display board through the light-emitting object depicted in the graphical image. A non-flammable bushing is positioned through the hole and an electric lamp assembly is positioned within the bushing. The bushing is comprised of a cylindrical tube with a flange at an inner end. The flange is positioned and adhered flush against the rear surface of the front panel display board. A shoulder is arranged inside the tube facing the flange to hold the lamp assembly in place and prevent it from passing completely through the tube. The potentially flammable front panel display board is insulated by the bushing from the heat producing surfaces of the lamp assembly for safety. A recessed tray is installed in a cut-out section of the rear panel enclosing board. A DC power jack is mounted in the recessed tray. The power cord from a standard AC/DC wall adaptor plugs into the power jack on the back of the picture, thereby hiding the large plug assembly from view. The power cord may be hidden behind the wall by threading it through a hole in the wall behind the picture.

14 Claims, 3 Drawing Sheets

WALL ART PICTURE DECORATED WITH ELECTRIC LAMPS

BACKGROUND OF THE INVENTION

1. Field of the Invention

This invention relates generally to illuminated pictures and lamp bushings.

2. Prior Art

Wall art pictures decorated with electric lamps and neon are known in the prior art. A typical one of such pictures is shown in FIG. 1. It is comprised of a graphical poster image, typically featuring a light emitting object 11, such as a lighthouse, which is mounted on a display board (substrate) 10 for presentation as traditional wall art. An incandescent lamp assembly 12 is positioned through a hole 13 in display board 10 to provide actual illumination for corresponding object 11 featured in the graphical image. Lamp 12 is energized by a low voltage electrical circuit contained within a cavity 18 shown in FIG. 2. The electric circuit connects to a visible plug and power cord 14 that connects to a power jack installed at the bottom of the display board or picture frame 15, and hangs down in a prominent and unattractive fashion. As shown in an enlarged view in FIG. 2, lamp assembly 12 is simply mounted through a hole 13 which has been cut into display board 10. In a typical configuration, a smaller piece of board 16, made of the same material, is adhered behind hole 13 for spacing and reinforcement. Lamp assembly 12 is secured in place with a surrounding layer of glue 17. Boards 10 and 16 are typically comprised of generic-quality foam boards, i.e., an expanded polyurethane foam core sandwiched between two cardboard paper sheets. Since hot lamp assembly 12 is in direct contact with the potentially flammable surfaces of foam boards 10 and 16, particularly their foam cores, a fire hazard is created.

OBJECTIVES OF THE INVENTION

Accordingly, the objectives of the present wall art picture decorated with electric lamps are: to emit actual light from a light-emitting object depicted in the graphical image; to enable a power cord and plug assembly to be hidden for more attractive appearance; and to insulate a flammable substrate display board in the picture from contact with the heat producing surfaces of a hot lamp assembly for safety.

Further objectives of the present invention will become apparent from a consideration of the drawings and ensuing description.

BRIEF SUMMARY OF THE INVENTION

The present wall art picture is comprised of a front panel display board and a rear panel enclosing board mounted in a frame. A poster featuring the graphical image of a light-emitting object is mounted to the outer surface of the front panel display board. A hole is made in the front panel display board in a strategic position through the light-emitting object depicted in the graphical image. A non-flammable bushing is positioned through the hole and an electric lamp assembly is positioned within the bushing. The bushing is comprised of a cylindrical tube with a flange at an inner end. The flange is positioned and adhered flush against the rear surface of the front panel display board. A shoulder is arranged inside the tube facing the flange to hold the lamp assembly in place and prevent it from passing completely through the tube. The potentially flammable front panel display board is insulated by the bushing from the heat producing surfaces of the lamp assembly for safety. The wiring of the electrical lamp assembly is enclosed for safety in a cavity between the front panel display board and the rear panel enclosing board. A recessed tray is installed in a cut-out section of the rear panel enclosing board. A DC power jack is mounted in the recessed tray. Power leads are connected between the DC power jack within the cavity and the lamp assembly. Additional lamp assemblies may also be provided. An optional push button ON-OFF switch is installed at the bottom of the frame and connected between the DC power jack and the lamp assembly. The power cord from a standard AC/DC wall adaptor plugs into the power jack mounted in the recessed tray on the back of the picture, thereby hiding the large plug assembly from view. At the option of the end-user, a small hole is made in the wall behind the picture, and the power cord is threaded down the interior of the wall to another hole made at baseboard level, where the cord proceeds to the nearest standard electrical outlet.

DRAWING REFERENCE NUMERALS

| | |
|---|---|
| 10) Front Panel Display Board | 11) Light-Emitting Object |
| 12) Electric Lamp Assembly | 13) Hole in Picture for Lamp Assembly |
| 14) Plug and Power Cord | 15) Frame |
| 16) Spacer Board | 17) Glue |
| 18) Internal Picture Cavity | 19) Rear Surface of Front Panel Display Board |
| 20) Front Panel Display Board | 21) Rear Panel Enclosing Board |
| 22) Frame | 23) Light-emitting Object |
| 24) Hole in Picture | 25) Insulator Bushing |
| 26) Electric Lamp Assembly | 27) Tube |
| 28) Bushing Flange | 29) Bushing Shoulder |
| 30) Recessed Tray for Power Jack | 31) Front Surface of Front Panel Display Board |
| 32) Cut-Out Section | 33) Flange Around Recessed Tray |
| 34) Open Rear Side of Recessed Tray | 35) Hidden Power Jack in Recessed Tray |
| 36) ON-OFF Switch | 37) Power Plug |
| 38) Power Cord | |

DETAILED DESCRIPTION OF THE INVENTION

Figure 1:
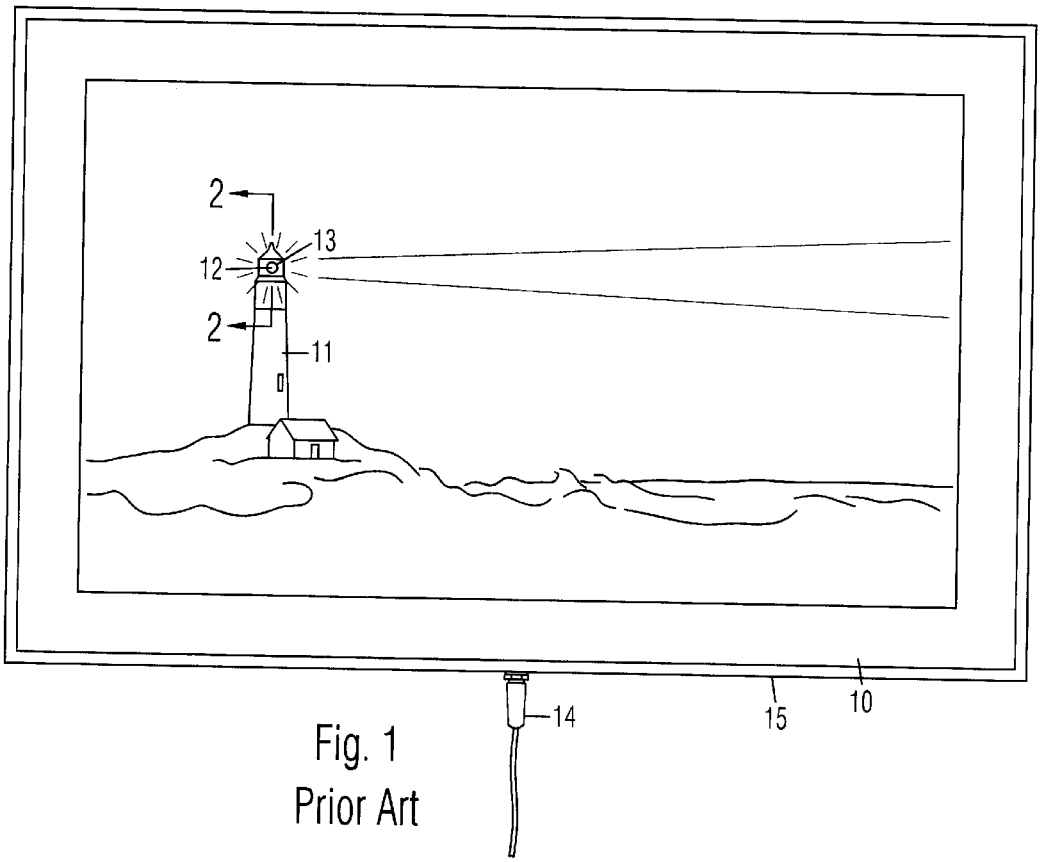
Fig. 1 Prior Art
FIG. 1 is a front view of a prior art wall art picture decorated with an incandescent electric lamp.
Figure 2:
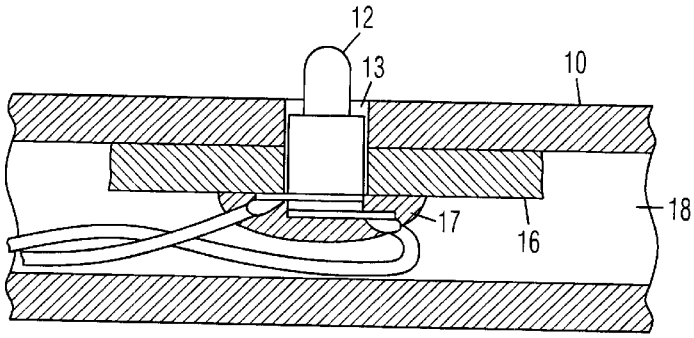
Fig. 2 Prior Art
FIG. 2 is a sectional view of the prior art picture, taken along line 2—2 in FIG. 1.
Figure 3:
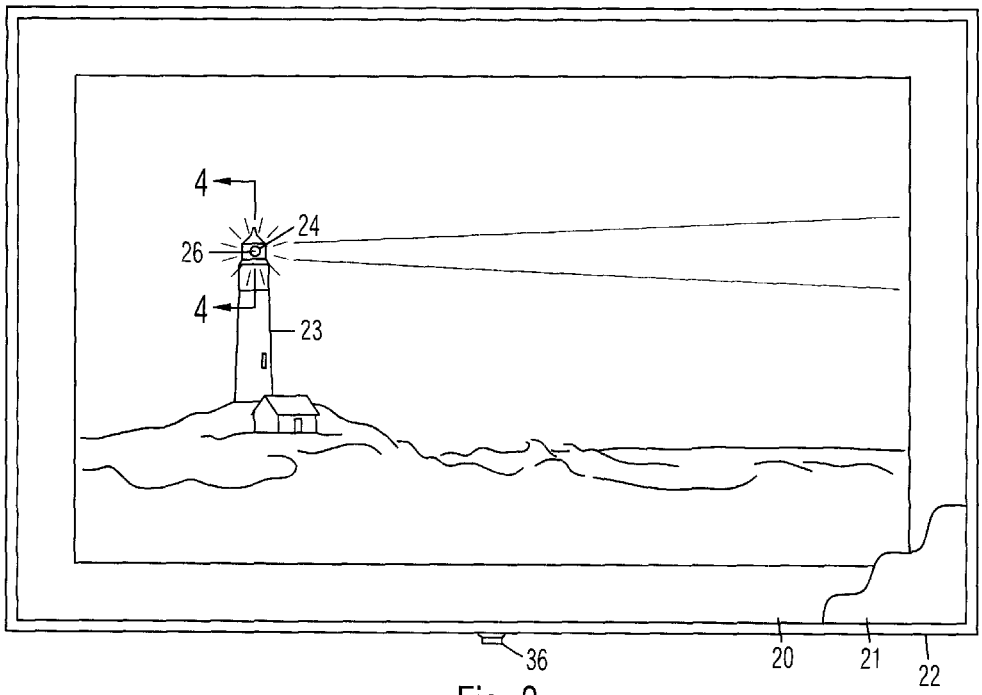
FIG. 3 is a front view of the present wall art picture decorated with an incandescent electric lamp.
Figure 4:
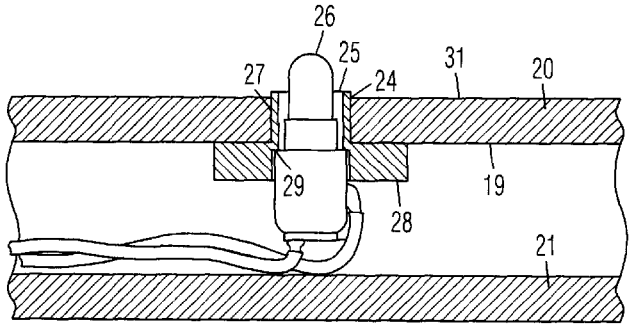
FIG. 4 is a sectional view of the present picture, taken along line 4—4 in FIG. 3.

FIGS. 3–4: Custom Bushing Insulates Hot Lamp Assembly for Safety

A preferred embodiment of the present wall art picture is shown in a front view in FIG. 3. It includes a front panel display board 20 and a rear panel enclosing board 21 mounted in a frame 22. A poster featuring the graphical image of a light-emitting object 23, such as a lighthouse, is mounted to an outer surface of front panel display board 20. Alternatively, other light-emitting objects may also be depicted, such as the headlights of a car, lighted buildings, street lights, stars, etc. A hole 24 is made in front panel display board 20 in a selected position through light-emitting object 23 depicted in the graphical image. An electric lamp assembly 26, such as an incandescent lamp, is fitted within a specially designed bushing and positioned within hole 24. In FIG. 4, the specially designed bushing 25 made of an insulating and non-flammable material is positioned through hole 24. Electric lamp assembly 26 is positioned within bushing 25 for emission of actual light from the light-emitting object featured in the graphical image. Bushing 25 is comprised of a cylindrical tube 27 with outer dimensions generally equal to hole 24, and a flange 28 around an inner end of tube 27. Flange 28 is positioned and adhered flush against a rear surface 19 of front panel display board 20. The outer end of tube 27 is generally flush with a front surface 31 of front panel display board 20 to insulate the entire length of hole 24. The outer end of tube 27 is preferably flange-free for being as inconspicuous as possible. A shoulder 29 is configured inside tube 27 facing flange 28 to hold lamp assembly 26 in place and prevent it from passing completely through tube 27. Potentially flammable front display board 20 is thus insulated by bushing 25 from contact with the heat producing surfaces of hot lamp assembly 26 for safety. The present picture and its construction has been reviewed by Underwriter's Laboratories, a widely recognized non-profit organization that evaluates electrical products for safety. With the addition of bushing 25, the picture was qualified as a safe product and was issued a UL listing.

Figure 5:
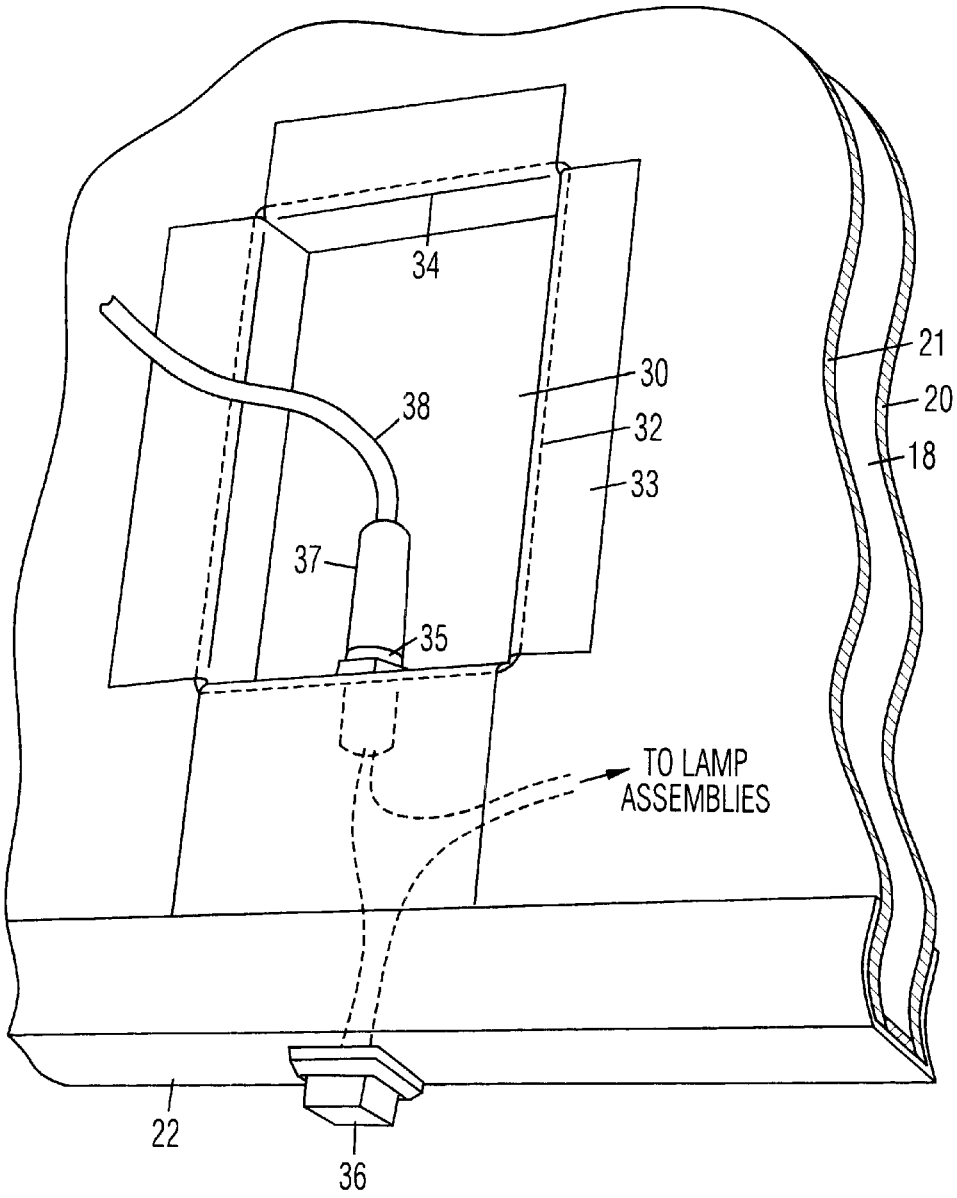
FIG. 5 is a rear perspective view of the present picture showing the recessed tray and the hidden installation of the power jack.

FIG. 5: Recessed Power Jack on Rear Panel Enclosing Board Allows Wiring Concealment As shown in FIG. 5, a recessed tray 30 is installed in a cut-out section 32 of rear panel enclosing board 21. Tray 30 is preferably made of an insulating material. Flanges 33 extend from an open rear side 34 of recessed tray 30. Open rear side 34 of recessed tray 30 is installed flush against the back side of rear panel enclosing board 21. An electric power jack 35 is installed within recessed tray 30. The axis of power jack 35 is preferably parallel to the plane of rear panel enclosing board 21. Alternatively, the axis of power jack 35 may be perpendicular to rear panel enclosing board 21 if cavity 18 is wide enough to accommodate power jack 35. Power Jack 35 is connected via wiring contained within internal cavity 18 to an ON-OFF power switch 36 (optional) mounted at a bottom edge of frame 22, and then to the electric lamp assembly. A power cord 38 and power plug 37 leading from a power source are connected to power jack 35 to energize the electrical circuit. Power plug 37 is thus hidden from view for best appearance. At the option of the end user, a small hole can be made in the wall behind the picture, and power cord 38 can be threaded down the walls' interior to another hole made at baseboard level, where power cord 38 typically reemerges and proceeds to the nearest electrical outlet. Power cord 38 can thus be also hidden from view for best appearance. If an in-wall power cord scheme is not feasible, power cord 38 can hang down the outside of the wall.

SUMMARY AND SCOPE

Accordingly, the present wall art picture emits actual light from a light-emitting object depicted thereon. It enables the power cord and/or plug to be hidden from view for a more attractive appearance. It insulates a potentially flammable substrate board in the picture from the heat producing surfaces of an electrical lamp assembly for safety.

Although the above description is specific, it should not be considered as a limitation on the scope of the invention, but only as an example of the preferred embodiment. Many variations are possible within the teachings of the invention. For example, different attachment methods, fasteners, materials, light sources, dimensions, etc. can be used unless specifically indicated otherwise. The relative positions of the elements can also vary and the shapes of the elements can vary. Therefore, the scope of the invention should be determined by the appended claims and their legal equivalents, not by the examples given.

I claim:

1. A wall art picture, comprising:

a front panel display board;

a hole in said front panel display board;

a non-flammable bushing positioned through said hole, wherein said bushing is comprised of a tube with a flange around an inner end, said tube is positioned in said hole with said flange against a rear surface of said front panel display board, an outer end of said tube is generally flush with a front surface of said front panel display board to insulate an entire length of said hole, said outer end of said tube is flange-free for being inconspicuous; and an electric lamp assembly positioned within said bushing, wherein when said lamp assembly is hot, said front panel display board is thermally insulated from said lamp assembly by said bushing for safety.

2. The wall art picture of claim 1, further including a frame around said front panel display board, a rear panel enclosing board mounted in said frame behind said front panel display board, and a cavity between said front panel display board and said rear panel enclosing board.

3. The wall art picture of claim 1, further including a graphical image of a light-emitting object arranged on said front surface of said front panel display board, wherein said hole is positioned through said light-emitting object.

4. The wall art picture of claim 1, further including a shoulder around an interior of said tube of said bushing facing said flange, wherein said lamp assembly is stopped by said shoulder from passing completely through said tube.

5. The wall art picture of claim 1, further including an ON-OFF switch arranged at a bottom of a frame around said front panel display board and connected to said lamp assembly.

6. A wall art picture, comprising:

a frame;

a front panel display board mounted in said frame;

a rear panel enclosing board mounted in said frame behind said front panel display board;

a cavity between said front panel display board and said rear panel enclosing board;

hole in said front panel display board;

an electric lamp assembly positioned within said hole;

a cut-out section in said rear panel enclosing board;

a recessed tray positioned in said cut-out section in said rear panel enclosing board; and a power jack mounted within said recessed tray, wherein said power jack is adapted to receive a power plug whereby said power plug is hidden behind said picture for a more attractive appearance, and a power cord adapted to be connected to said power plug to be inserted into a hole cut into a wall behind said picture;

a plurality of flanges around an open rear side of said recessed tray engaged against a rear surface of said rear panel enclosing board.

7. The wall art picture of claim 6, wherein an axis of said power plug is parallel to said rear panel enclosing board for compactness.

8. The wall art picture of claim 6, further including a graphical image of a light-emitting object arranged on an outer surface of said front panel display board, wherein said hole is positioned through said light-emitting object.

9. The wall art picture of claim 6, further including an ON-OFF switch arranged at a bottom of said frame and connected to said lamp assembly and said power jack.

10. A wall art picture, comprising:

a frame;

a front panel display board mounted in said frame;

a rear panel enclosing board mounted in said frame behind said front panel display board;

a cavity between said front panel display board and said rear panel enclosing board;

a hole in said front panel display board;

a non-flammable bushing positioned through said hole, wherein said bushing is comprised of a tube with a flange around an inner end, said tube is positioned in said hole with said flange against a rear surface of said front panel display board, an outer end of said tube is generally flush with a front surface of said front panel display board to insulate an entire length of said hole, said outer end of said tube is flange-free for being inconspicuous;

an electric lamp assembly positioned within said bushing, wherein when said lamp assembly is hot, said front panel display board is thermally insulated from said lamp assembly by said bushing for safety;

a cut-out section in said rear panel enclosing board;

a recessed tray positioned in said cut-out section in said rear panel enclosing board; and a power jack mounted within said recessed tray, wherein said power jack is adapted to receive a power plug whereby said power plug is hidden behind said picture for a more attractive appearance, and a power cord adapted to be connected to said power plug to be inserted into a hole cut into a wall behind said picture.

11. The wall art picture of claim 10, further including a graphical image of a light-emitting object arranged on said front surface of said front panel display board, wherein said hole is positioned through said light-emitting object.

12. The wall art picture of claim 10, further including a shoulder around an interior of said tube of said bushing facing said flange, wherein said lamp assembly is stopped by said shoulder from passing completely through said tube.

13. The wall art picture of claim 10, further including a plurality of flanges around an open rear side of said recessed tray engaged against a rear surface of said rear panel enclosing board.

14. The wall art picture of claim 10, further including an ON-OFF switch arranged at a bottom of said frame and connected to said lamp assembly and said power jack.

* * * * *